US006609878B1

(12) United States Patent
Ootoshi et al.

(10) Patent No.: US 6,609,878 B1
(45) Date of Patent: Aug. 26, 2003

(54) METHOD OF DISASSEMBLING TURBINE EQUIPMENT AND THE TURBINE EQUIPMENT

(75) Inventors: Tatsuya Ootoshi, Hitachi (JP); Takanori Aramaki, Hitachi (JP); Sakae Ebata, Hitachi (JP); Norihide Tooyama, Mito (JP)

(73) Assignees: Hitachi, Ltd., Tokyo (JP); Hitachi Life Corporation, Hitachi (JP); Hitachi Engineering Co., Ltd., Hitachi (JP)

( * ) Notice: Subject to any disclaimer, the term of this patent is extended or adjusted under 35 U.S.C. 154(b) by 0 days.

(21) Appl. No.: 09/936,839

(22) PCT Filed: Aug. 11, 1999

(86) PCT No.: PCT/JP99/04346

§ 371 (c)(1),
(2), (4) Date: Jan. 25, 2002

(87) PCT Pub. No.: WO01/12955

PCT Pub. Date: Feb. 22, 2001

(51) Int. Cl.[7] ..... F01D 25/00; F01D 25/28

(52) U.S. Cl. ..... 415/1; 415/118; 415/213.1

(58) Field of Search ..... 415/1, 108, 118, 415/213.1, 214.1, 215.1, 220

(56) References Cited

FOREIGN PATENT DOCUMENTS

| | | | | |
|---|---|---|---|---|
| JP | 62243903 A | * 10/1987 | ..... | F01D/25/00 |
| JP | 63143303 | 6/1988 | ..... | F01D/25/00 |
| JP | 63147797 | 6/1988 | ..... | F01D/25/00 |
| JP | 9151706 | 6/1997 | ..... | F01D/25/28 |

* cited by examiner

*Primary Examiner*—Edward K. Look
*Assistant Examiner*—Richard A. Edgar

(57) ABSTRACT

Supports are provided on the upper outer casing of each turbine of a turbine unit, and the upper inner casing of the turbine is temporarily placed on the supports of the upper outer casing, which is temporarily placed on the operating floor. By placing the casings temporarily in that way, a large space can be secured for the inspection of the turbine unit, and the inspection can be carried out quickly, which increases the operating ratio of the whole plant including the turbine unit. This invention is useful mainly for turbine units and their overhaul.

13 Claims, 12 Drawing Sheets

METHOD OF DISASSEMBLING TURBINE EQUIPMENT AND THE TURBINE EQUIPMENT

SUMMARY OF THE INVENTION

This application claims the priority of PCT International No. PCT/JP99/04346, filed Japan on Aug. 11, 1999, the disclosure of which is expressly incorporated by reference herein.

The present invention relates to a turbine-unit disassembling method and a turbine unit. More particularly, the present invention relates to a turbine unit disassembling method and a turbine unit suitably applicable to boiling-water-reactor power plants.

The turbine building of a boiling-water-reactor power plant houses a turbine unit, a generator to be driven by the turbine unit, and so on. The turbine unit comprises a high-pressure turbine and three low-pressure turbines. The turbine unit has to be overhauled periodically.

Each low-pressure turbine comprises a rotor with blades, diaphragms, an upper inner casing and a lower casing to enclose the rotor and the diaphragms, and an upper outer casing to cover the upper inner casing. The casings are so constructed that the upper outer and inner casings can be separated from the lower casing. The upper outer and inner casings are joined to the common lower casing to be ready for the operation of said low-pressure turbine.

To inspect lower-pressure turbines, they are disassembled. Disclosed in the Japanese Unexamined Patent Application No. 11-84049 is a technique for temporarily placing and keeping the disassembled components of low-pressure turbines until they are reassembled.

More specifically, a middle floor is provided along a plurality of low-pressure turbines in such a way that it does not interfere with radiation shielding bodies which protrude upward from the operating floor of the turbine building of a nuclear power plant. The middle floor is supported by supports constructed on the operating floor. The diaphragms disassembled from the low-pressure turbines in such a way are temporarily placed on the racks on the middle floor, and disassembled small components are carried to below the middle floor and temporarily placed there.

Japanese Unexamined Patent Application No. 7-279616 includes a casing for low-pressure turbines with, the casing having a horizontal part on its top portion. Piping is made on the top portion of the casing, and the horizontal part serves as a foothold during the inspection of the piping.

The object of the present invention is to increase the operating ratios of plants with turbine unites.

The first aspect of the present invention is to provide a method of disassembling a turbine unit. The method include the steps of (i) removing the upper outer casings from a turbine unit and placing them at places other than the place of the turbine unit and (ii) removing the upper inner casings from the turbine unit and placing them on the upper outer casings. In accordance with this method, the upper inner casings removed from a turbine unit require no floor space for their temporary placing and keeping because they are placed and kept on the upper outer casings until they are reassembled to the turbine unit. Accordingly, a large working space can be secured, which makes the inspection of the turbine unit easy and quick and, thereby, shortens the nonoperating time of the turbine unit and increases the operating ratio of the whole plant including the turbine unit.

The second aspect of the present invention provides another method of disassembling a turbine unit. The method includes the steps of (i) removing the upper outer casings from a turbine unit and placing them at places other than the place of the turbine unit, (ii) setting a stand over each of the upper outer casings so that the stand straddles said casing, and (iii) removing the upper inner casings from the turbine unit and placing them on the stands. In accordance with this method, the upper inner casings removed from a turbine unit require no floor space for their temporary placement and retention because they are placed and kept on stands, each straddling an upper outer casing, until they are reassemble to the turbine unit. Accordingly, a large working space can be secured, which makes the inspection of the turbine unit easy and quick and, thereby, shortens the nonoperating time of the turbine unit and increases the operating ratio of the whole plant including the turbine unit. Additionally, it is not necessary to consider the strength of the upper outer casings in order to have them support the upper inner casings.

The third aspect of the present invention further provides that each stand has a means for moving horizontally so as to take a position to straddle one of the upper outer casings. This method as well as the method of the second aspect shortens the nonoperating time of the turbine unit and increases the operating ratio of the whole plant including the turbine unit. Furthermore, as with the second aspect, it is not necessary to consider the strength of the upper outer casings in order to have them support the upper inner casings. Moreover, each stand can be set over an upper outer casing without using an overhead crane.

The fourth aspect of the present invention provides yet another method of disassembling a turbine unit. In this method, the upper inner casing of one turbine being disassembled, among a plurality of turbines, is placed on the upper outer casing of another turbine not being disassembled. In accordance with this method, because the upper inner casing of one turbine being disassembled is placed on the upper outer casing of another turbine not being disassembled, the upper inner casing requires no floor space. Accordingly, a large working space can be secured, which makes the inspection of the turbine unit easy and quick and, thereby, shortens the nonoperating time of the turbine unit and increases the operating ratio of the whole plant including the turbine unit. Additionally because the upper inner casing removed from the turbine being disassembled is placed on the upper outer casing of the turbine not being disassembled which is located near the former turbine, the turbine can be disassembled and reassembled in a relatively short time.

The fifth aspect of the present invention provides still another method of disassembling a turbine unit. The method includes the steps of (i) setting a stand over the upper outer casing of one turbine not being disassembled, among a plurality of turbines, so as to have the stand straddle the casing and (ii) placing the upper inner casing of another turbine being disassembled on the stand. In accordance with this method, because the upper inner casing of one turbine being disassembled is placed on the stand straddling the upper outer casing of another turbine not being disassembled, the upper inner casing requires no floor space. Accordingly, a large working space can be secured, which makes the inspection of the turbine unit easy and quick and, thereby, shortens the nonoperating time of the turbine unit and increases the operating ratio of the whole plant including the turbine unit. Once again because the upper inner casing removed from the turbine being disassembled can be placed nearby, that is, above the upper outer casing of the other turbine not being disassembled without imposing a load on the latter turbine, the disassembly and reassembly of the former turbine can be carried out quickly without concern about any other turbine.

The sixth aspect of the present invention provides a further method of disassembling a turbine unit. In this method, the upper inner casings of one turbine unit being disassembled, among a plurality of turbine units, are placed on upper outer casings of other turbine units not being disassembled. In accordance with this method, because two turbine units or more offer temporary-placing places for the upper inner casings of one turbine unit being disassembled, a large space can be secured around it for inspection work. Accordingly, its inspection can be carried out quickly, which shortens the nonoperating time of the turbine unit and increases the operating ratio of the whole plant including such turbine units.

The seventh aspect of the present invention provides the method according to the first, fourth, or sixth aspect, wherein said upper inner casings or casing is placed on supports which are provided on said upper outer casings or casing. This method as well as the methods of the first, fourth, and sixth aspects increases the operating ratio of the whole plant including the turbine unit. Furthermore, upper inner casings or casing can be placed on and supported by the supports stably.

The eighth aspect of the present invention provides a method of disassembling and inspecting a turbine unit. The method include the steps of (i) removing the upper outer casings from a turbine unit and placing them at places other than the place of the turbine unit, (ii) removing the upper inner casings from the turbine unit and placing them on the upper outer casings, (iii) inspecting the turbine unit, (iv) assembling the upper inner casings to the turbine unit, and (v) assembling the upper outer casings to the turbine unit. In accordance with this method, the upper inner casings of a turbine unit can be placed on its upper outer casings just by placing them in the order of their removal, and the outer and inner casings can be left in the one-upon-the-other state until the turbine unit is reassemble. Therefore, a large working space can be secured around the turbine unit for inspection, which can be carried out quickly. Just by lifting the casings, they can be conveyed to the turbine unit quickly in the order of their reassembly. Preferably, the upper outer and inner casings are conveyed with an overhead crane during the disassembly and reassembly of the turbine unit. In that case, it is not necessary to shift the overhead crane from the upper outer casing to the upper inner casing and again to the upper outer casing while they are conveyed. Thus, by using an overhead crane, the turbine unit can be disassembled, inspected, and reassembled quickly.

The ninth aspect of the present invention provides another method of disassembling and inspecting a turbine unit. The method includes the steps of (i) removing the upper outer casings from a turbine unit and placing them at places other than the place of the turbine unit, (ii) setting a stand over each of the upper outer casings so as to have the stand straddle said casing, (iii) removing the upper inner casings from the turbine unit and placing them on the stands, (iv) inspecting the turbine unit, (v) assembling the upper inner casings to the turbine unit, (vi) removing the stands from over the upper outer casings, and (vii) assembling the upper outer casings to the turbine unit. In accordance with this method, the upper inner casings of a turbine unit can be placed above its upper outer casings just by placing them in the order of their removal, in the same way as the method of the eighth aspect except for the use of stands. includes the steps of (i) removing the upper outer casing from one turbine being disassembled, among a plurality of turbines, and placing it at a place other than the place of the turbine, (ii) removing the upper inner casing from the turbine and placing it on the upper outer casing of another turbine not being disassembled, (iii) inspecting the disassembled turbine, and (iv) assembling the upper inner casing to the disassembled turbine. In accordance with this method, the upper inner casing of one turbine being disassembled is placed on the upper outer casing of another turbine not being disassembled. Therefore, the floor space otherwise occupied by the upper inner casing can be used for the inspection work of the components of the disassembled turbine. Accordingly, a large floor space for inspection can be secured, and the inspection can be carried out quickly. Furthermore because the turbines of a turbine unit are arranged adjacent to each other, the conveying distance of the upper inner casing of a turbine being disassembled is short and, hence, the conveying time of the casing is short. Therefore, the turbine unit can be disassembled, inspected, and reassembled quickly.

The eleventh aspect of the present invention provides still another method of disassembling and inspecting a turbine unit. The method includes the steps of (i) removing the upper outer casing from one turbine being disassembled, among a plurality of turbines, and placing it at a place other than the place of the turbine, (ii) removing the upper inner casing from the turbine and placing it on a stand which is set in advance over the upper outer casing of another turbine not being disassembled so that the stand straddles the casing, (iii) inspecting the disassembled turbine, (iv) assembling the upper inner casing to the disassembled turbine, and (v) assembling the upper outer casing to the disassembled turbine. In accordance with this method, the upper inner casing of one turbine being disassembled can be placed above the upper outer casing of another turbine not being disassembled in the same way as the method of the tenth aspect except for the use of a stand. Therefore, the turbine unit can be disassembled, inspected, and reassembled quickly.

The twelfth aspect of the present invention provides a turbine unit wherein each turbine comprises (i) a rotor with blades, (ii) an upper inner casing and a lower casing for enclosing the rotor, and (iii) an upper outer casing for covering the upper inner casing, the upper outer casing having supports which are so positioned as to receive and support the bottom surface of the upper inner casing outside the upper outer casing. Because the upper inner casings removed from the turbine unit can be placed on the upper outer casings removed from the same, the former casings require no floor space. Therefore, a large space can be secured for the inspection of the turbine unit. Accordingly, the inspection can be carried out quickly, which shortens the nonoperating time of the turbine unit and increases the operating ratio of the whole plant including the turbine unit.

The thirteenth aspect of the present invention provides a turbine unit wherein each turbine includes (i) a rotor with blades, (ii) an upper inner casing and a lower casing for enclosing the rotor, and (iii) an upper outer casing for covering the upper inner casing, the upper outer casing having reinforcing ribs on its outer surface and supports which are provided on the ribs in such positions as to receive and support the bottom surface of the upper inner casing. As in the case of the turbine unit of the twelfth aspect, the upper inner casings removed from this turbine unit can be placed on the supports of the upper outer casings removed from the same. Therefore, a large space can be secured for the inspection of the turbine unit. Accordingly, the inspection can be carried out quickly, which shortens the nonoperating time of the turbine unit and increases the operating ratio of the whole plant including the turbine unit. Furthermore, the supports are provided on the reinforcing ribs of the upper outer casings, the strain of the upper outer casings is prevented and they can support the upper inner casings firmly.

The fourteenth aspect of the present invention provides the turbine unit according to the twelfth or thirteenth aspect, wherein each of said supports has a stopper protruding upward from its top surface. This turbine unit as well as the turbine units of the seventh and the eighth aspects increases the operating ratios of power plants. Besides, the stoppers of this turbine unit prevent the upper inner casings from sliding on and falling off the upper outer casings.

BRIEF DESCRIPTION OF DRAWINGS

FIG. 1 is a side view of a turbine unit which the first embodiment of the present invention is applied to.

DETAILED DESCRIPTION OF THE PREFERRED EMBODIMENTS

The inspection of turbines units of a nuclear power plant or a thermal power plant involves the disassembly and the reassembly of turbines. While turbines in a turbine building are being disassembled, inspected, and reassembled, their components (hereinafter referred to as "disassembled components") are placed on the operating floor of the turbine building.

The upper outer and inner casings, which are relatively large among disassembled components of low-pressure turbines of a turbine unit, may be temporarily placed at places near the turbine unit on the operating floor without putting one upon another. In this case, however, they occupy a large area, reducing the free space on the operating floor.

As for nuclear power plants in particular, it is difficult from the radiation-controlling point of view to carry disassemble components of low-pressure turbines in a turbine building into another building or outdoors even for a little while. Therefore, the overhaul of low-pressure turbines has to be carried out within the available space in the turbine building. Additionally because components of the generator and the low-pressure turbine unit, which require periodic overhaul, in a turbine building are very heavy, they have to be handled and inspected within areas covered by lifting devices such as overhead cranes.

Disassembled components of the generator and the turbine unit in a turbine building are placed collectively in an area covered by overhead cranes. In the area, a large number of disassembled components and inspection tools and materials intermingle and many workers crowd for inspection. Under such congested condition, inspection cannot be carried out efficiently.

Accordingly, some measures to enable efficient overhaul of turbine units are required. If a turbine unit can be overhauled efficiently, the operating ratio of the turbine unit increases and such increase contributes toward the increase in the operating ratio of the plant including the turbine unit.

The first embodiment of the present invention is as follows.

Figure 1:
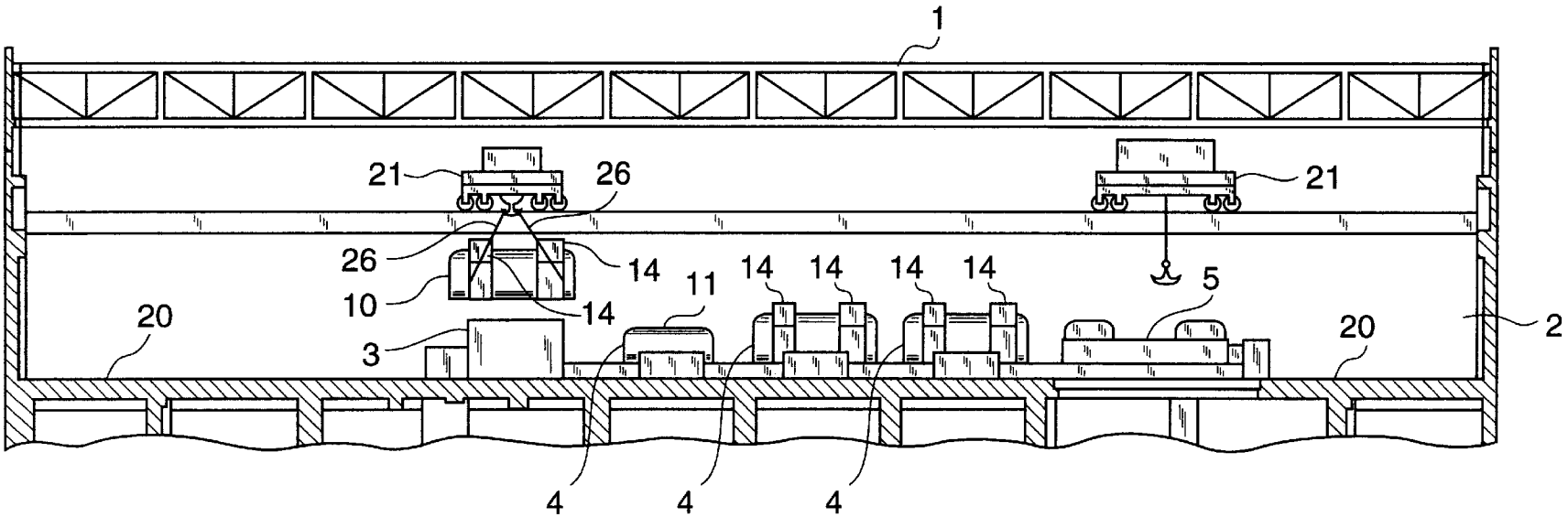

As shown in FIG. 1, installed in the turbine building 1 of a nuclear power plant are a turbine unit, a generator 5 which is driven by the turbine unit and generates electricity, and so on. The turbine unit comprises one high-pressure turbine 3 and three low-pressure turbines 4. The reference numeral 20 is the operating floor. The turbine unit has to be overhauled periodically.

Figure 2:
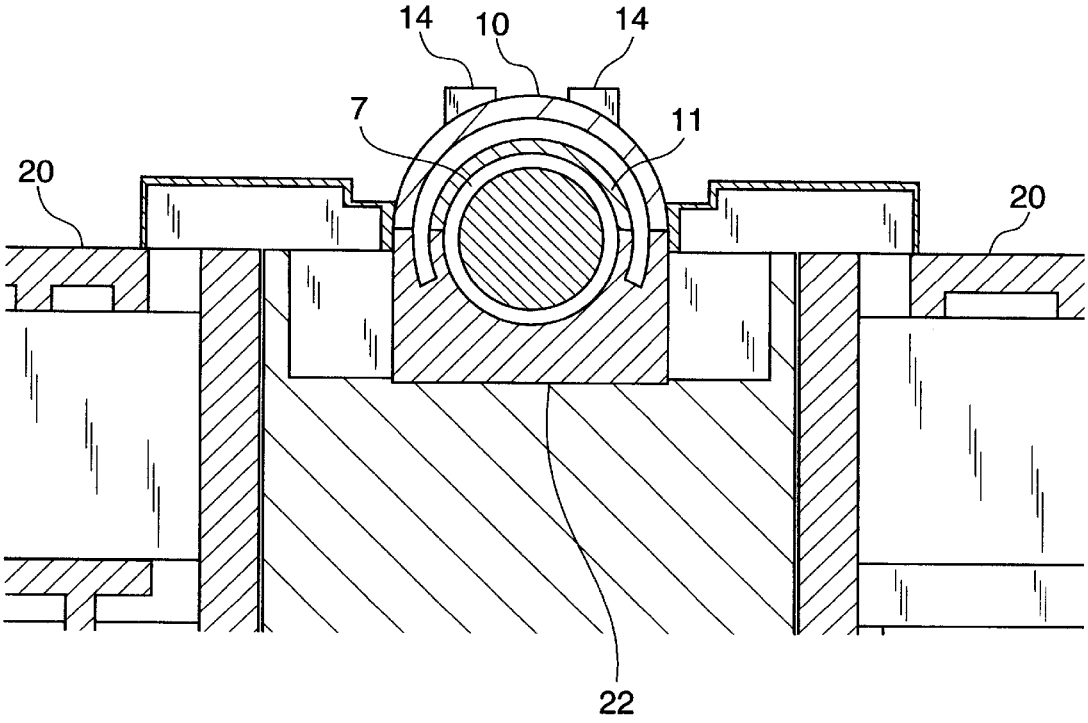
FIG. 2 is a longitudinal sectional view of a low-pressure turbine of the turbine unit of FIG. 1.

As shown in FIG. 2, each low-pressure turbine, 4 comprises a rotor 7 with blades, diaphragms (not shown), an upper inner casing 11 and a lower casing 22 both enclosing the rotor 7 and the diaphragms, and an upper outer casing 10 covering the upper inner casing 11. The upper outer casing 10 is provided to prevent such steam from spouting into the space 2 above the operating floor 20 as may leak out of the inner space enclosed by the upper inner casing 11 and the lower casing 22.

Figure 4:
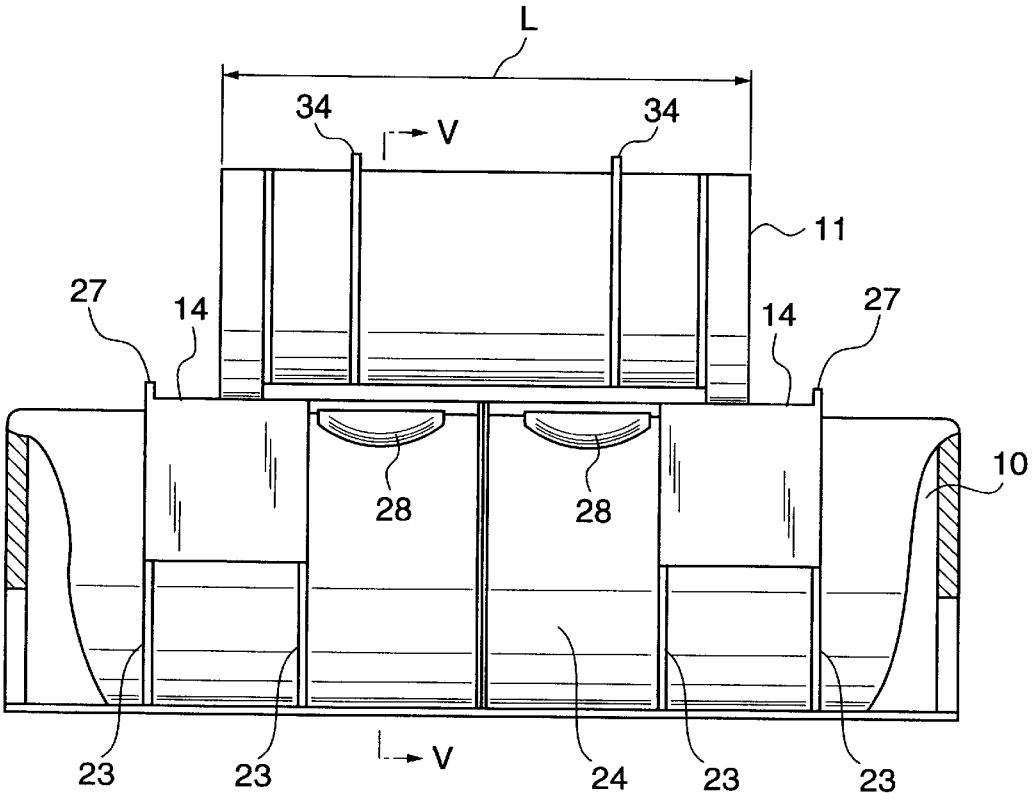
FIG. 4 is an elevational view of a set of upper outer and inner casings, the former casing temporarily placed on the floor, the latter casing temporarily placed on the former casing.
Figure 5:
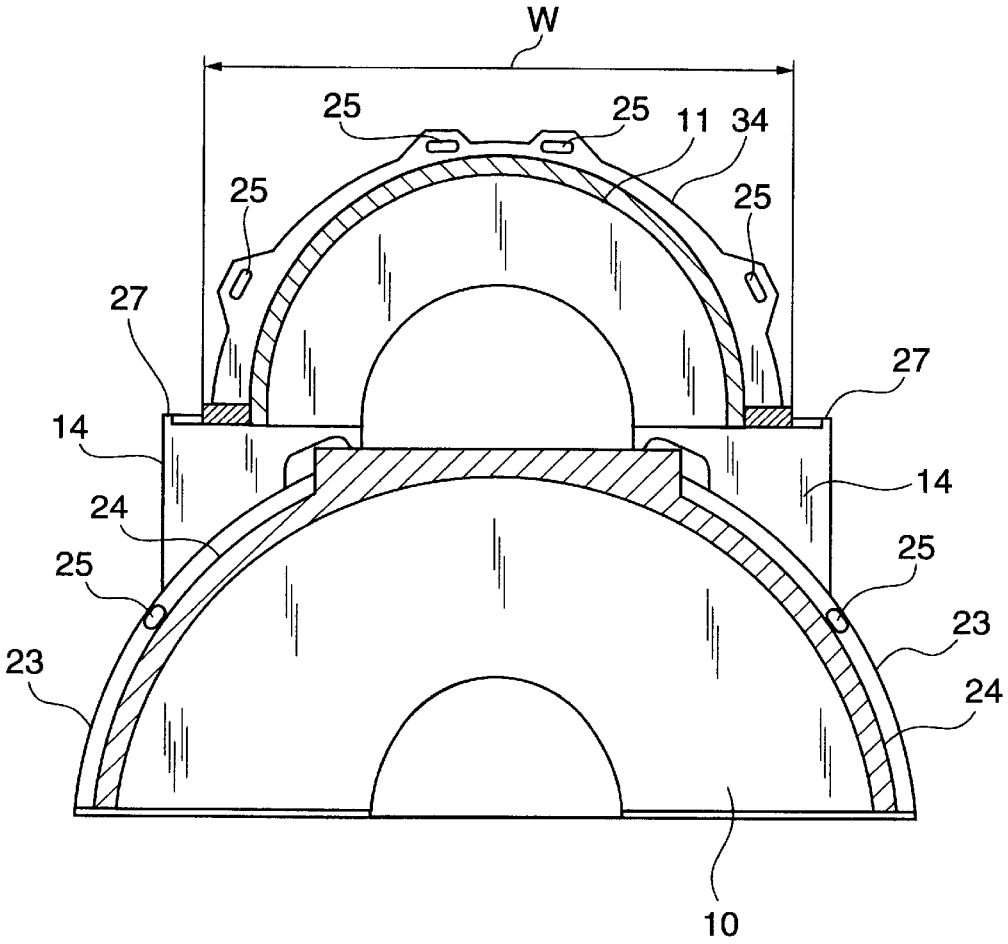
FIG. 5 is a sectional view of the casings of FIG. 4.
Figure 6:
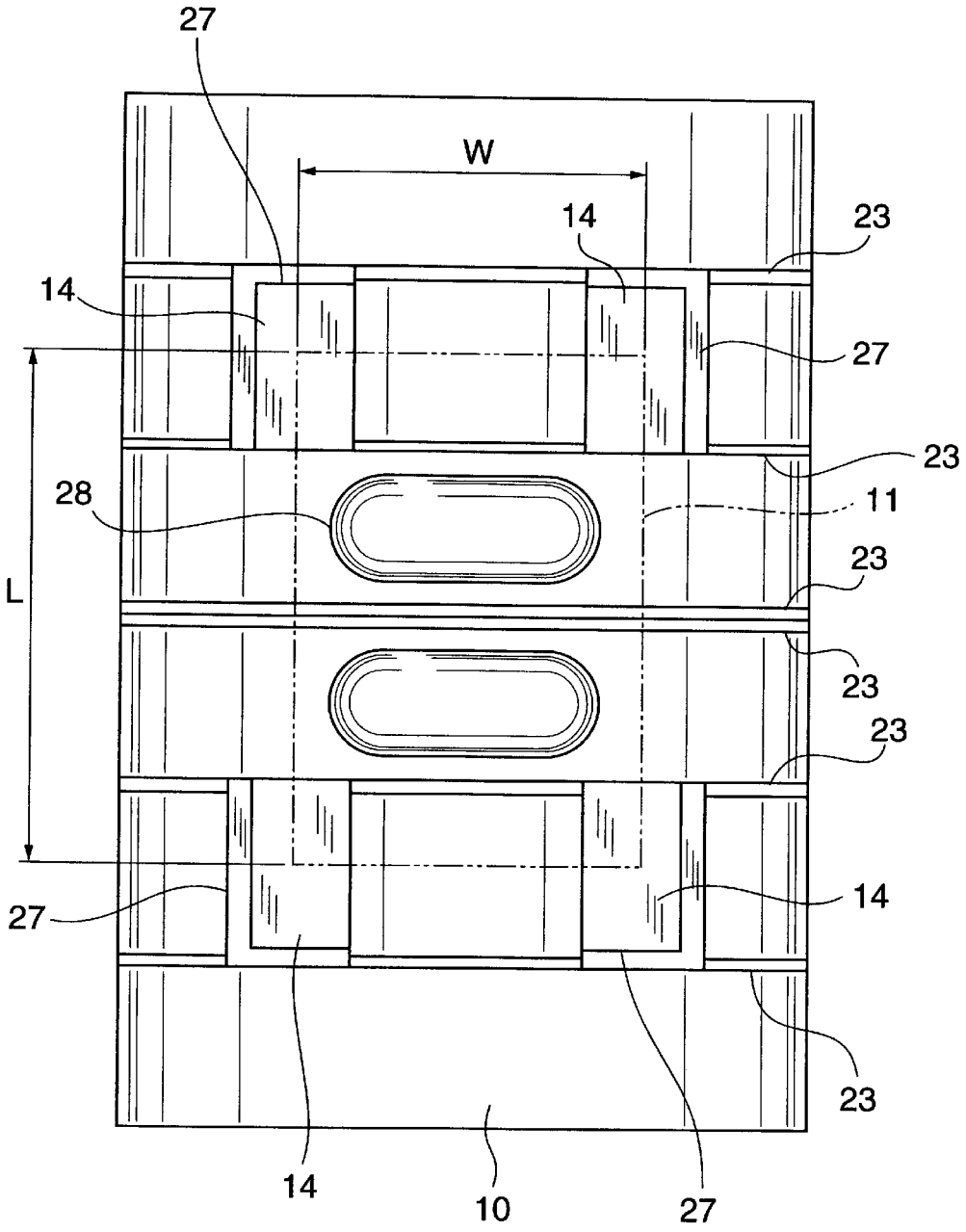
FIG. 6 is a plan view of the upper outer casing of FIG. 7.
Figure 7:
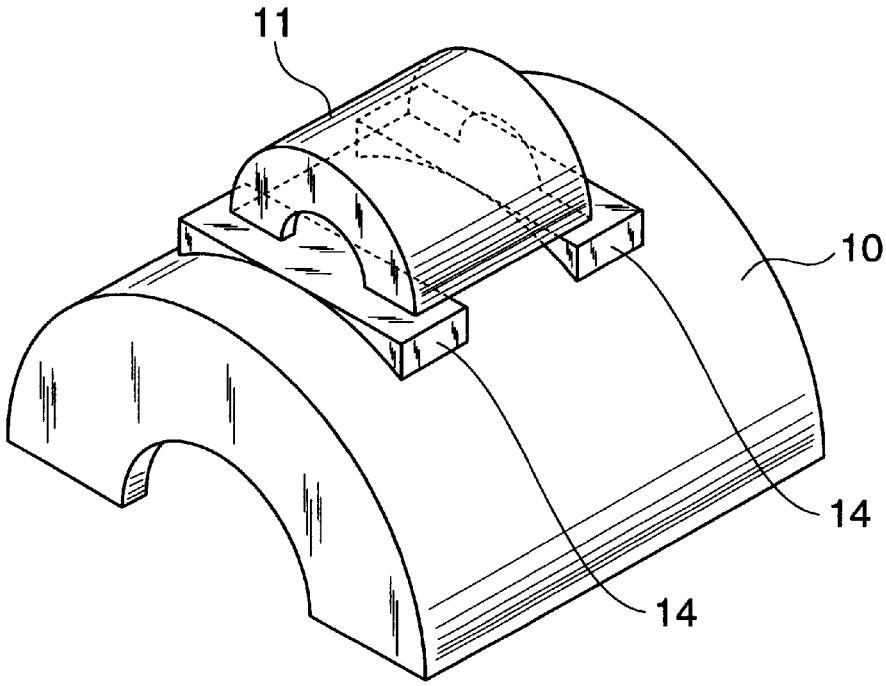
FIG. 7 is a perspective view of the upper outer and inner casings of FIG. 4.

The construction of the upper outer casing 10 will now be described with reference to FIGS. 4, 5, and 6. The upper outer casing 10 has excessive-pressure releasing plates 28 on it. The excessive-pressure releasing plates 28 open, as rapture disks do for example, to release steam and thereby protect the upper outer casing 10 when the steam pressure in the upper outer casing 10 rises to an excessive level.

The upper outer casing 10 has a generally semicylindrical body 24 and a plurality of reinforcing ribs 23 on the outer surface of the body 24. The ribs 23 and the body 24 give desired strength to the upper outer casing 10. The desired strength of the upper outer casing 10 is such that it is capable of bearing the load of the upper inner casing 11. The upper inner casing 11 also has similar ribs 34 on its outer surface.

The ribs 23 and 34 have holes 25. As shown in FIG. 1, by setting ropes 26 (or hangers) through the holes 25, the upper outer and inner casings 10 and 11 can be conveyed with an overhead crane 21 which is installed high in the space 2 above the operating floor 20. Namely, the holes 25 are an engaging means to engage ropes 26 (or hangers) which are hung from an overhead crane 21.

Four supports 14 to support the upper inner casing 11 are provided on the upper outer casing 10 in such a way that they do not cover the excessive-pressure releasing plates 28. Each support 14 is constructed of metal plates which are joined to a plurality of adjacent ribs 23 of the upper outer casing 10 so that said support has a horizontal top. Provided along the outer edge of the top of each support 14 is a stopper 27 which protrudes upward.

The upper outer casing 10 and the supports 14 may be made as a single casting, or the supports 14 may be made separately from the upper outer casing 10 and then fixed to the upper outer casing 10 by welding or by a mechanical means. The four supports 14 are disposed individually so as to support simultaneously the longitudinal end portions (the end portions of the length L shown in FIG. 4) and the lateral end portions (the end portions of the width W shown in FIG. 5) of the upper inner casing 11.

Because the supports 14 are disposed as described above, the bottom surfaces of the upper inner casing 11 are able to sit on the lower casing 22.

The handling of the disassemble components of the turbine unit and the generator during their overhaul will now be described.

As shown in FIG. 1, the generator 5, the high-pressure turbine 3, and the low-pressure turbines 4 are so disposed that their upper portions show above the operating floor 20. Accordingly, their disassembled components can be easily hung and conveyed with an overhead crane 21 which moves in space 2 and ropes 26 as mentioned above. The overhead crane 21 can raise and lower a disassembled component hanging from it, travel horizontally hanging a disassembled component, and traverse horizontally in the direction orthogonal to the traveling direction hanging a disassembled component. By using such movement of the overhead crane 21, disassembled components of the high-pressure turbine 3, the low-pressure turbines 4, and the generator 5 can be conveyed to and placed at their temporary-placing places on the operating floor 20 shown in FIG. 3, where they are kept until their reassembly.

Figure 3:
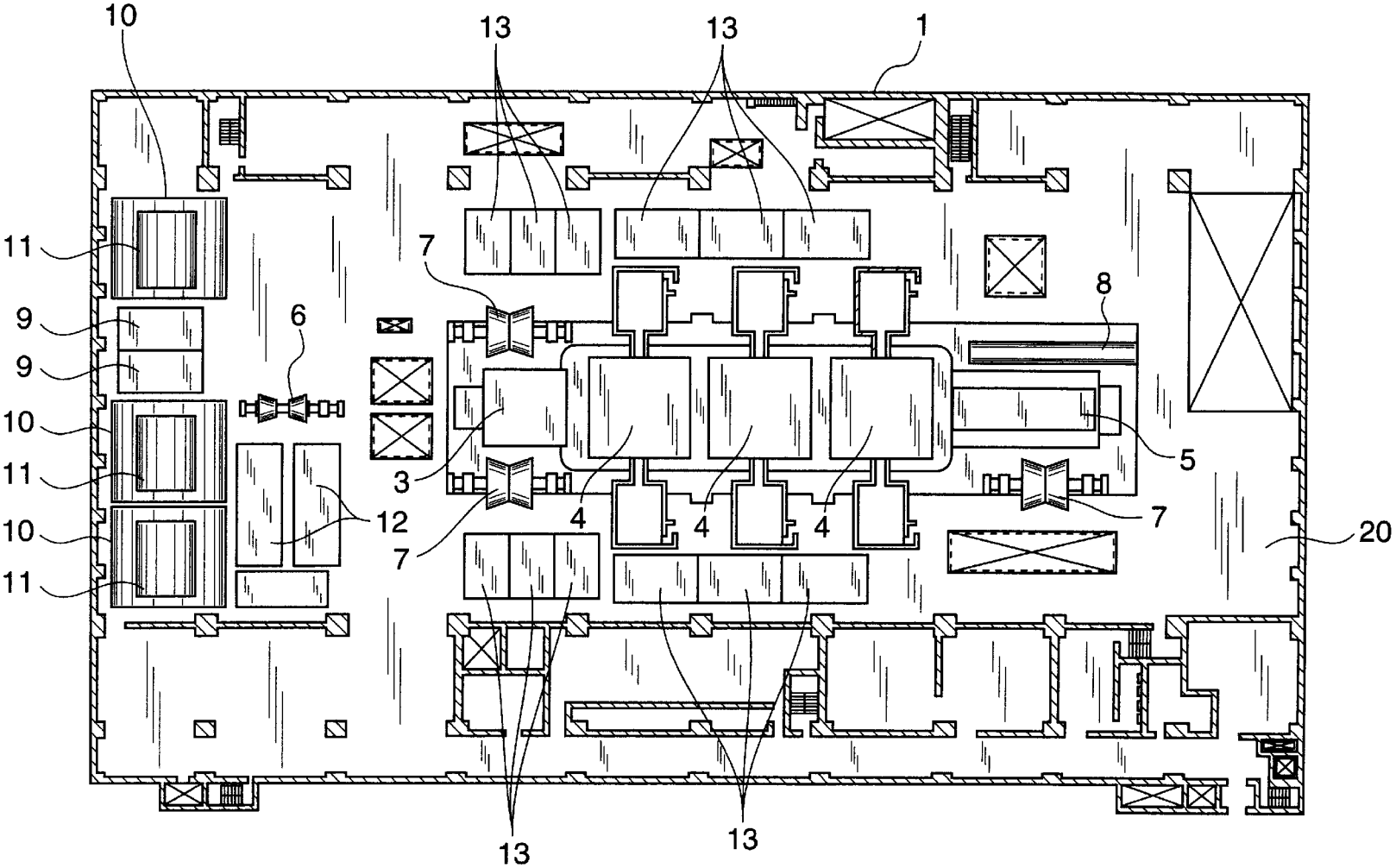
FIG. 3 is a plan view of the operating floor of the turbine building of a nuclear power plant, the disassembled components of the turbine unit of FIG. 1 temporarily placed on the floor.

Namely, the rotor 8 of the generator 5, the shielding walls 9, the rotor 6, and the diaphragms 12 of the high-pressure turbine 3, and the upper outer casings 10, the upper inner casings 11, the rotors 7, and the diaphragms 13 of the low-pressure turbines 4 all disassembled and taken out are temporarily placed at the prescribed places on the operating floor 20 shown in FIG. 3.

The disassembly of the low-pressure turbines 4 will now be described in detail. The bolts fixing the upper outer casing 10 to the lower casing 22 of a low-pressure turbine 4 are removed. Then, ropes 26 hanging from an overhead crane 21 are set through the holes 25 of the upper outer casing 10 to lift it. The overhead crane 21 conveys the upper outer casing 10 to its temporary-placing place on the operating floor 20 by a side wall of the turbine building 1. Then, the overhead crane 21 lowers the upper outer casing 10 at the temporary-placing place. If it is necessary to protect the upper outer casing 10 from being damaged by its contact with the operating floor 20, buffers such as sleepers are arranged on the operating floor 20 and the upper outer casing 10 is placed on them.

The bolts fixing the upper inner casing 11 to the lower casing 22 are removed. The upper inner casing 11 is lifted and conveyed with the overhead crane 21 to the position directly above the upper outer casing 10 which is already placed at its temporary-placing place. Then, the upper inner casing 11 is lowered and placed on the supports 14 of the upper outer casing 10 with the overhead crane 21 as shown in FIGS. 4 and 5.

Because the tops of the supports 14 are horizontal, the upper inner casing 11 can be placed stably on the upper outer casing 10. The stoppers 27 prevent the upper inner casing 11 from sliding on and falling off the upper outer casing 10 under external force. Besides, damage to the upper inner casing 11 can be prevented by placing rubber sheets or sleepers on the supports 14 and placing the upper inner casing 11 on them.

The upper inner casing 11 is left as it is on the upper outer casing 10 until it is reassembled to the low-pressure turbine 4. Even in this state, the upper outer casing 10 is capable of supporting the upper inner casing 11 firmly without developing such deformation as affects its usability because it is reinforced by the ribs 23.

Because the temporary-placing place for the upper outer and inner casings 10 and 11 is located near a side wall of the turbine building 1, the upper outer and inner casings 10 and 11 in the one-upon-the-other state do not disturb the conveyance of other disassembled components with the overhead crane 21.

Because the upper part of the low-pressure turbine 4 is now open, its rotor 7 and diaphragms 13 can be taken out one by one with the overhead crane 21 from the low-pressure turbine 4 and conveyed to their prescribed places on the operating floor 20 shown in FIG. 3 to be placed there temporarily. The blades of the low-pressure turbine 7, the stationary blades of the diaphragms 13, and so on are inspected and repaired, if necessary, by workers while they are temporarily placed on the operating floor 20.

The other two low-pressure turbines 4 are also disassembled and their disassembled components are temporarily placed on the operating floor 20 in the same way. According to the present embodiment, because the upper inner casing 11 of each low-pressure turbine is placed on its upper outer casing 10, it is not necessary to first remove the upper outer casing 10 and lower it to a space (a retreating-space for the upper outer casing 10) on the operating floor 20 with an overhead crane 21, and then lift the upper inner casing 11 with the overhead crane 21 to convey it to its temporary-placing place, and finally to left the upper outer casing 10 again with the overhead crane 21 to convey it onto the upper inner casing 11. Accordingly, such a retreating-space for the upper outer casing 10 is unnecessary.

By placing the upper inner casing 11 of each low-pressure turbine 4 on its upper outer casing 10 as described above, the upper inner casing 11 can be kept in the space within the boundary of the temporary-placing place for the upper outer casing 10. Accordingly, the floor space can be used effectively for the inspection work and, hence, the inspection can be carried out quickly.

After the inspection of the rotors 7 and other components of the low-pressure turbines 4, they are assembled as follows. The diaphragms 13 to be set in the lower casing 22 of a low-pressure turbine 4 are lifted from the operating floor 20 and conveyed into the lower casing 22 with an overhead crane 21. Then, the rotor 7 is conveyed into the lower casing 22. Each of the diaphragms 13, already conveyed into the lower casing 22, takes a position between the runners of the rotor 7. The remaining diaphragms 13 on the operating floor 20 are conveyed and inserted between the runners of the rotor 7.

Because the upper inner casing 11 to be first fitted to the lower casing 22 is on the upper outer casing 10, the upper inner casing 11 can first be lifted and conveyed with the overhead crane 21 to be fitted to the lower casing 22. Then, the upper outer casing 10 is lifted and conveyed with the overhead crane 21 to be fitted to the lower casing 22. Thus, the assembly of the low-pressure turbine 4 is completed. According to the present embodiment, it is not necessary during the reassembly of a low-pressure turbine 4 to shift an overhead crane 21 from the upper outer casing 10 to the upper inner casing 11 and again to the upper outer casing 10, and hence no retreating-space for the upper outer casing 10 to effect such overhead-crane shifting is required.

In accordance with the present embodiment, the disassembly and the reassembly of the low-pressure turbines 4 can be carried out quickly because the shifting of an overhead crane 21 between the upper outer and inner casings 10 and 11 is not required and, hence, no retreating-space for the upper outer casing 10 to effect such shifting is required. Because the turbine unit can be disassembled, inspected, and reassembled quickly, its nonoperating time decreases and its operating ratio increases, which contributes toward the improvement in the operating ratio of the power plant. The present embodiment is also applicable to the turbine units of thermal power plants.

The second embodiment is as follows. Although the upper outer casing 10 of each low-pressure turbine 4 is provided with the supports 14 in the first embodiment described above, no supports 14 are provided in the second embodiment. Due to no provision of supports 14, the temporarily placing work of the upper outer and inner casings 10 and 11 in accordance with the second embodiment differs from that in the first embodiment as described below.

Figure 8:
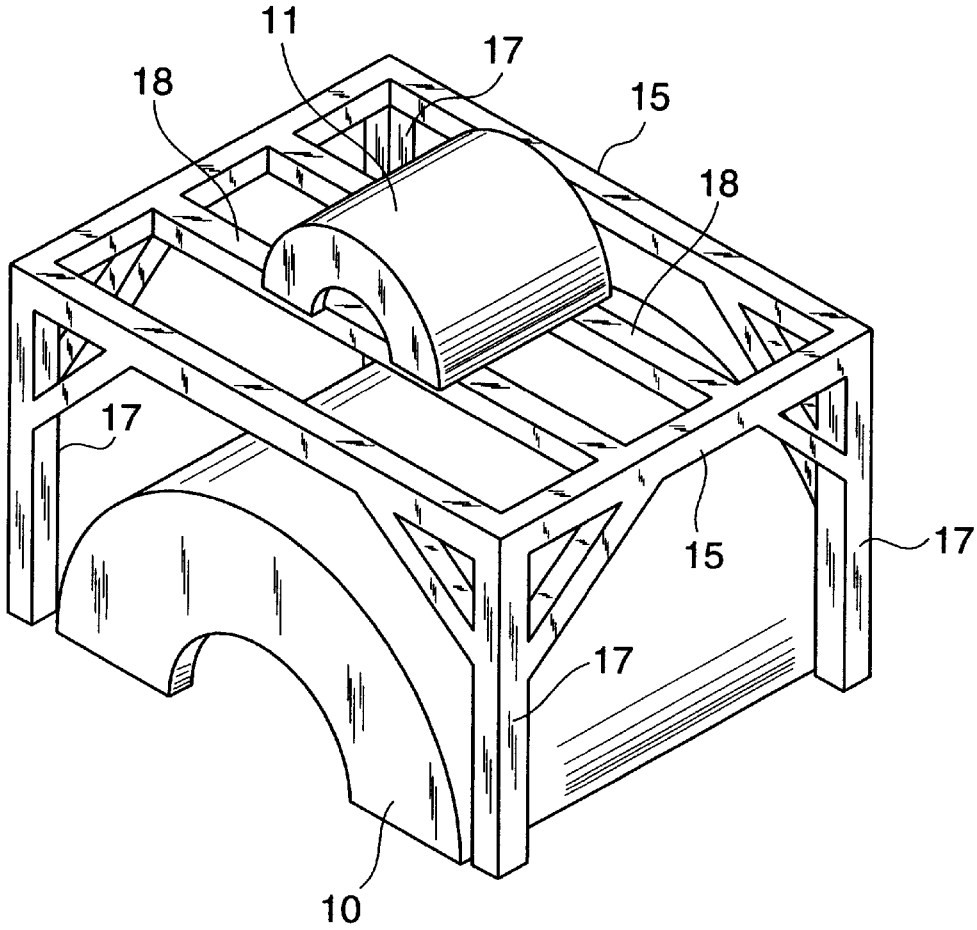
FIG. 8 is a perspective view of an example of the stand of the second embodiment of the present invention, an upper outer casing temporarily placed on the floor, an upper inner casing temporarily placed on a stand which is set over the upper outer casing.

The upper outer casing 10, disassembled from a low-pressure turbine 4, is conveyed with an overhead crane 21 to its prescribed temporary placement position on the operating floor 20. Then, a stand 15, which is retreated in advance from the temporary-placing place to an appropriate space, is lifted and conveyed to the temporary placement position of the upper outer casing 10 with the overhead crane 21. The stand 15 is lowered and placed on the operating floor 20 so as to have it straddle the upper outer casing 10 as shown in FIG. 8. In this way, the stand 15 can be lifted and carried with an overhead crane 21.

Then, the upper inner casing 11 is disassembled from the low-pressure turbine 4. The upper inner casing 11 so removed is put on the two horizontal, parallel beams 18 of the stand 15 with the overhead crane 21 as shown in FIG. 8. The beams 18 are supported by the four legs 17 of the stand 15. Because the upper inner casing 11 is put on the two beams 18, it can be supported stably. It is preferable to put buffers such as rubber sheets or sleepers on the beams 18 in order to prevent the upper inner casing 11 from being damaged by its direct contact with the beams 18.

To reassemble the low-pressure turbine 4 after its inspection, the rotor 7 and the diaphragm 13 are first set in the lower casing 22. Then, the upper inner casing 11 is conveyed with the overhead crane 21 from on the stand 15 to above the lower casing 22 and lowered on it. The upper inner casing 11 and the lower casing 22 are joined together with bolts.

Then, the stand 15 is removed, or retreated, to an appropriate space by lifting and conveying it with the overhead crane 21. Thereafter, the upper outer casing 10 is conveyed to above the lower casing 22 and lowered on it with the overhead crane 21. The upper outer casing 10 and the lower casing 22 are joined together with bolts.

Because the stand 15 is portal-shaped and has an elevated superstructure, the stand 15 can be put in any place on the operating floor 20 of which the area is large enough to receive the four legs 17 of the stand 15. When the stand 15 is retreated to a separate space, it does not occupy large area on the operating floor 20. For example, when the stand 15 is retreated to the separate space, equipment and materials for overhaul can be put among the legs 17 of the stand 15, or disassembled components smaller than the space between, and the height of, the legs 17 can be temporarily put under the stand 15.

Figure 9:
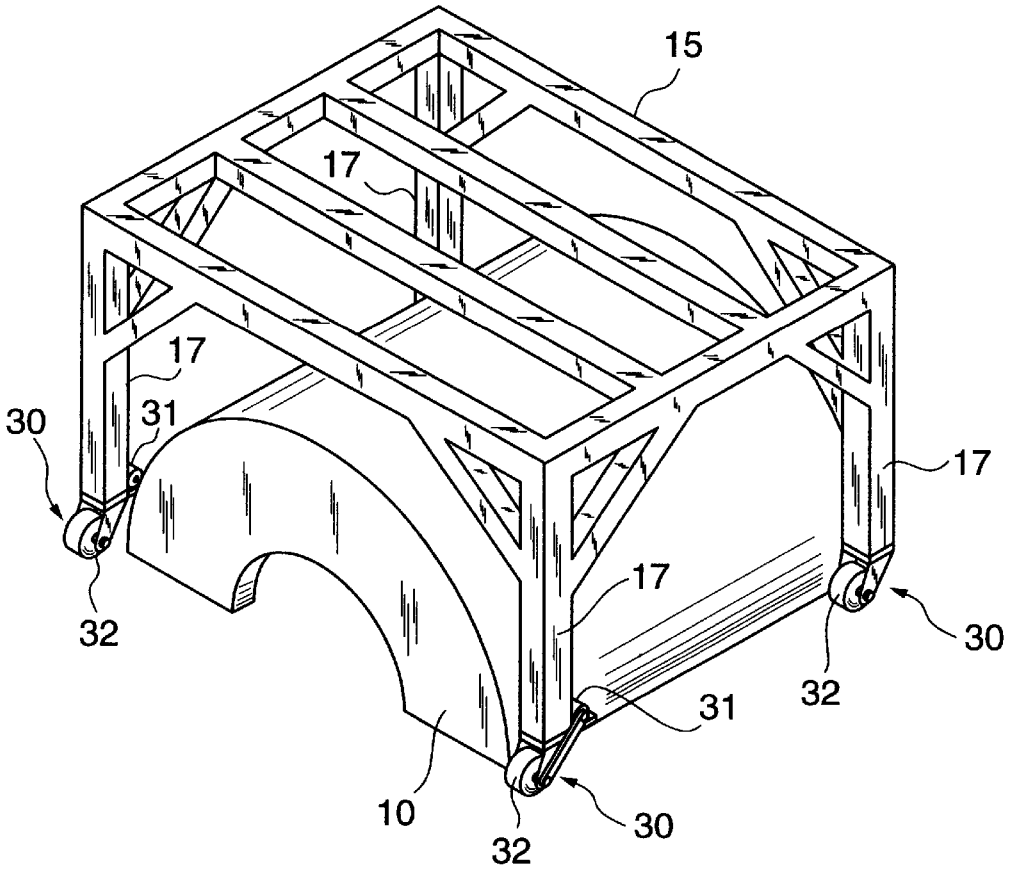
FIG. 9 is a perspective view of another example of the stand of the second embodiment.
Figure 10:
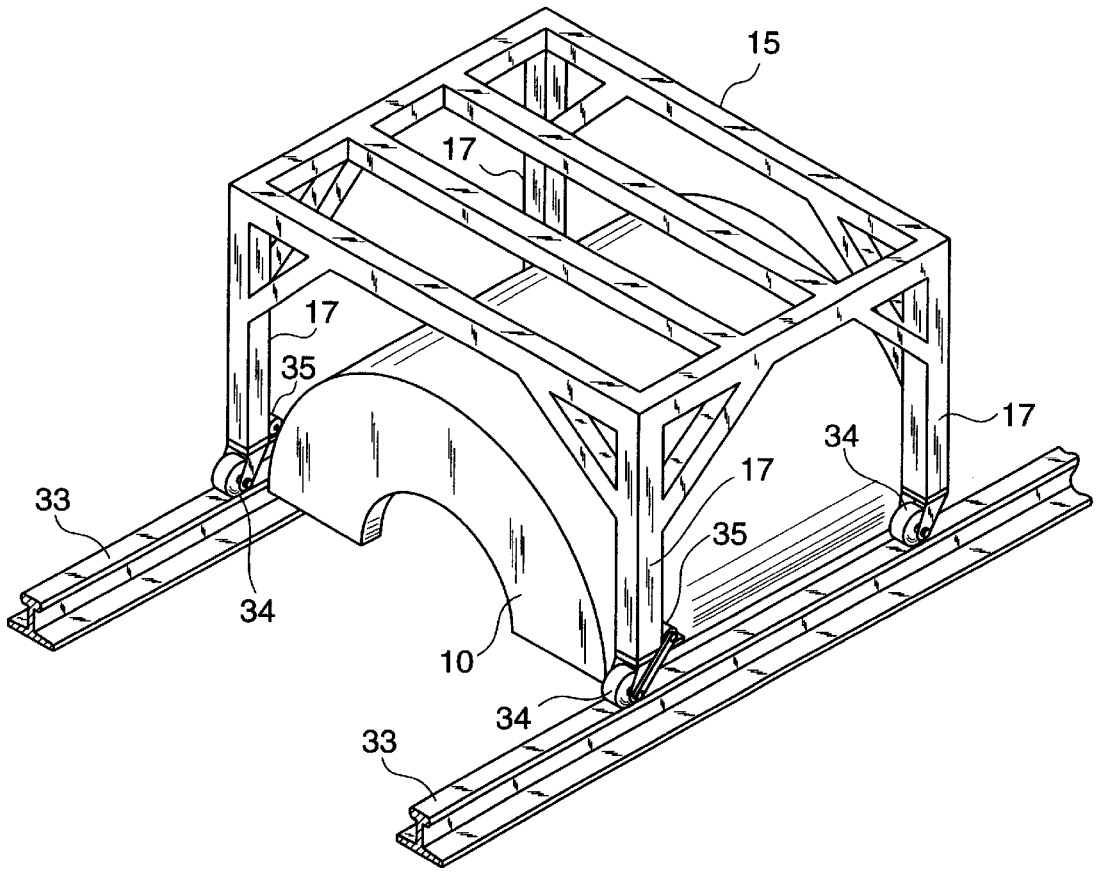
FIG. 10 is a perspective view of still another example of the stand of the second embodiment.

Although the stand 15 is moved in three dimensions with an overhead crane 21 in the above case, it may be configured so as to be freely movable on the floor as follows. Namely, the stand 15 may be provided with the following means for moving on the floor. In FIG. 9, the stand 15 is provided with casters 30 at the bottoms of its legs 17, and each caster 30 is provided with a motor 31, which drives the wheel 32 of said caster 30. In this way, the stand 15 is moved on the operating floor 20. In FIG. 10, rails 33 are laid along the sides of the temporary-placing place for the upper outer casing 10, and put on the rails 33 are wheels 34 which are secured to the bottoms of the legs 17 of the stand 15. Motors 35 drive the wheels 34 to move the stand 15 on the rails 33.

In this way, the stand 15 driven by the motors 31 or 33, can move by itself. As the stand 15 is mobile, an overhead crane 21 is not required for the movement of the stand 15. Therefore, the conveying work of the stand 15 can be excluded from the operating schedule of the overhead cranes 21, and hence the flow of the whole work can be made simple.

In either case, the stand 15 moves on its own from the temporary placement position for the upper outer casing 10 to an appropriate space and opens the upper space of the temporary-placing place so that the upper outer casing 10 carried by an overhead crane 21 can be lowered and placed there. The upper outer casing 10 carried by an overhead crane 21 is lowered and placed at the temporary-placing place of which the upper space is open. After the temporary placing of the upper outer casing 10, the stand 15 moves on its own toward the temporarily placed upper outer casing 10 and, as in FIGS. 9 and 10, takes a position to straddle the upper outer casing 10. Then, the upper inner casing 11 is conveyed, lowered, and temporarily placed on the beams 18 of the stand 15 with the overhead crane 21.

Thus, the upper outer and inner casings 10 and 11 are temporarily placed in two stages at one and the same temporary-placing place, the former taking a position under the stand 15, the latter taking a position on the stand 15. As in the case of the first embodiment, the second embodiment does not require work for shifting an overhead crane 21 from the upper outer casing 10 to the upper inner casing 11 and again to the upper outer casing 10 or a retreating-space for the upper outer casing 10 during the conveyance of the casings between their temporary placement position and the turbine unit.

As in the case of the first embodiment, the second embodiment brings about the effect of reducing the nonoperating time and increasing the operating ratio of the turbine unit and thereby increasing the operating ratio of the power plant. Besides, in accordance with the second embodiment, the supports 14 on the upper outer casing 10 required in the first embodiment for supporting the upper inner casing 11 are unnecessary. By using the stand 15 during the overhaul of a conventional turbine unit of which the upper outer casings 10 have no such supports 14, its upper inner casings 11 can be placed above its upper outer casings 10.

In accordance with the second embodiment, therefore, the present invention can be applied to the inspection of low-pressure turbines 4 of existing plants. Besides, the consideration of strength of upper outer casings in order to support inner outer casings on them is unnecessary.

The third embodiment is as follows. The third embodiment is a partial modification of the first embodiment as described below.

Figure 11:
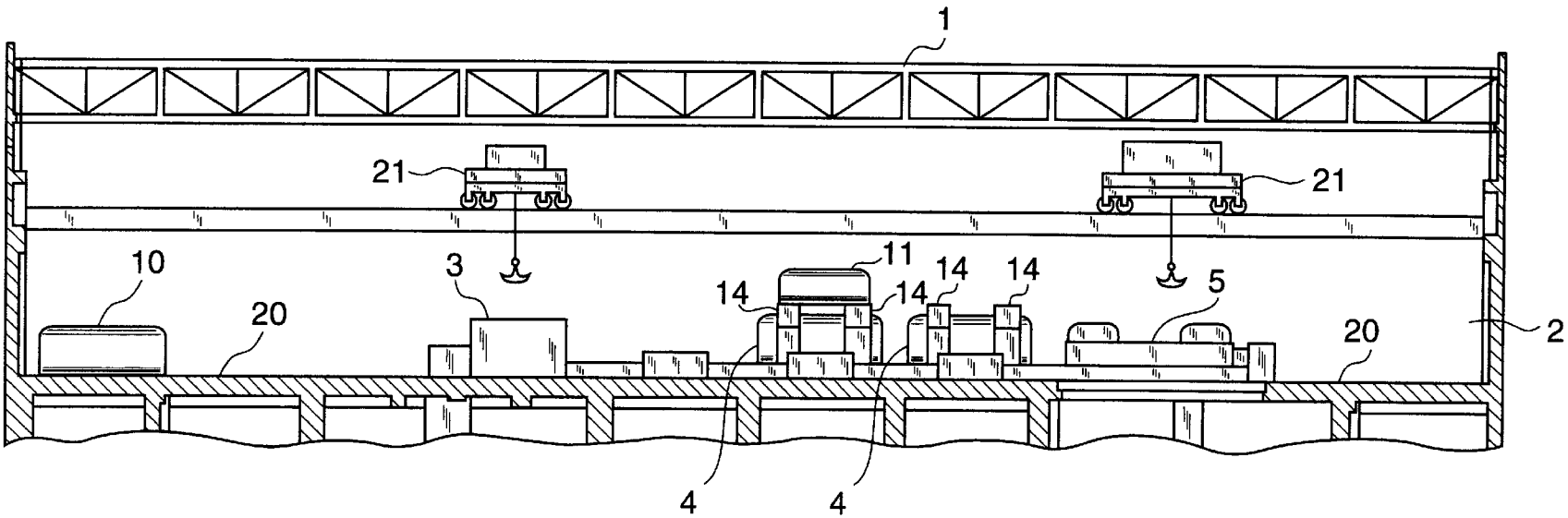
FIG. 11 is a sectional view of a turbine building. The upper outer casing of a low-pressure turbine is temporarily placed on the floor and its upper inner casing is temporarily placed on the outer casing of another low-pressure turbine in accordance with the third embodiment of the present invention.

Namely, at the time of partial inspection in which one of the three low-pressure turbines 4 is inspected, its removed casings are placed at their temporary-placing places as follows. As shown in FIG. 11, the upper outer casing 10 of one low-pressure turbine 4 to be overhauled is, with an overhead crane 21, conveyed to and placed at its temporary placement position assigned by a side wall of the operating floor 20 as shown in FIG. 3, as in the case of the first embodiment. Then, the upper inner casing 11 of the low-pressure turbine 4 is lifted, conveyed, and lowered, with the overhead crane 21, on the supports 14 of the upper outer casing 10 of an adjacent low-pressure turbine 4 not to be disassembled at present.

Because the upper inner casing 11 of one low-pressure turbine 4 being disassembled is placed on the supports 14 of the upper outer casing 10 of an adjacent low-pressure turbine 4 not to be disassembled as described above, the temporary placing of the upper inner casing 11 can be made in a two-stage positional relation with the upper outer casing 10. It is preferable to put buffers between the upper outer casing 10 and the upper inner casings 11 to prevent them from being damaged.

After the inspection of the disassembled low-pressure turbine 4, its upper inner and outer casings 11 and 10 are reassembled to it as follows. The upper inner casing 11 of the disassembled low-pressure turbine 4 placed temporarily on the supports 14 of the upper outer casing 10 of the adjacent undisassembled low-pressure turbine 4 is first lifted, conveyed, and lowered on the lower casing 22 of the disassembled low-pressure turbine 4 with the overhead crane 21. Then, the upper outer casing 10 of the disassembled low-pressure turbine 4 placed temporarily on the operating floor 20 is lifted, conveyed, and lowered on the lower casing 22 of the disassembled low-pressure turbine 4 with the overhead crane 21.

As in the case of the first embodiment, the third embodiment brings about the effect of reducing the nonoperating time and increasing the operating ratios of turbine units and thereby increasing the operating ratios of power plants. Additionally, in accordance with the third embodiment, the upper inner casing 11, disassembled from a low-pressure turbine 4 being overhauled, can be placed nearby. Therefore, the third embodiment enables the carry out of the disassembly and reassembly of a low-pressure turbine 4 in a shorter time than the first embodiment, which increases the operating ratio of the power plant further.

In the case where the upper inner casing 11 of one low-pressure turbine 4 being disassembled is to be placed on the upper outer casing 10, without supports 14, of another low-pressure turbine 4 not being disassembled, a stand 15 of the second embodiment is so set over the latter turbine 4 that the stand straddles the turbine 4, and the upper inner casing 11 of the former turbine 4 is lifted, conveyed, and lowered on the stand 15 with an overhead crane 21.

Figure 12:
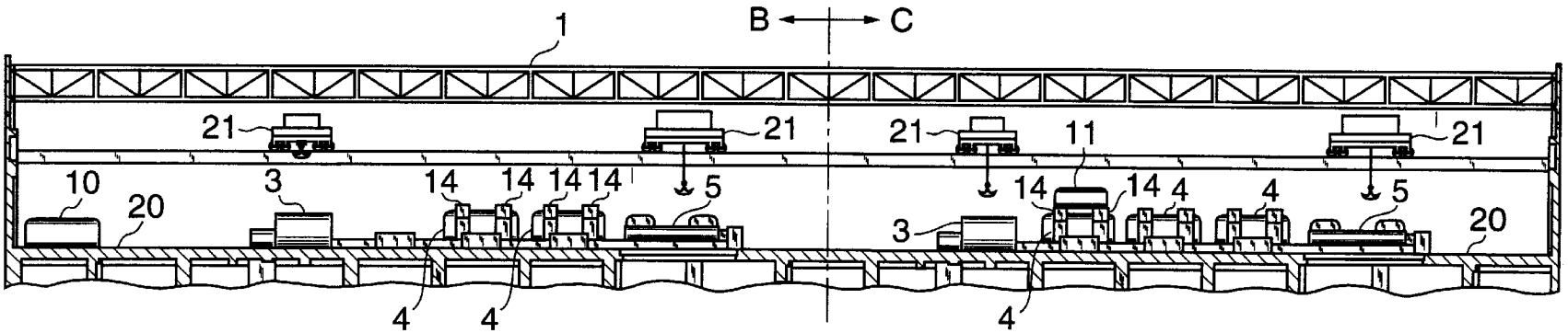
FIG. 12 is a sectional view of a turbine building which houses two turbine units. The upper outer casing of a low-pressure turbine belonging to one turbine unit is temporarily placed on the floor and its upper inner casing is temporarily placed on the upper outer casing of a low-pressure turbine belonging to the other turbine unit.

The cases wherein low-pressure turbines 4 lend temporary placement positions to each other were described above. However, if a turbine unit and another turbine unit are disposed on the B side and the C side, respectively, in a turbine building, the casings of a low-pressure turbine 4 may be handled as follows. Namely, as shown in FIG. 12, the upper inner casing 11 of a low-pressure turbine 4 of the turbine unit being disassembled on the B side is lifted, conveyed, and temporarily placed, with the overhead crane 21, on the supports 14 of the upper outer casing 10 of a low-pressure turbine 4 of the turbine unit not being disassembled in the C side. By having two turbine units offer temporary placement positions to each other, a wide working space can be secured around a turbine unit being disassembled in the B side, and its overhaul can be carried out more efficiently.

In the second embodiment wherein the stand 15 is used, or in the case when the stand 15 is adopted in the third embodiment, while the stand 15 is not used as a means for receiving and supporting the upper inner casing 11 temporarily, it may be used as a rack for keeping articles three-dimensionally in the turbine building.

In this way, a removed upper inner casing 11 can be temporarily placed on or above a removed or unremoved upper outer casing 10 in any embodiment. Therefore, the upper outer and inner casings 10 and 11 disassembled from a low-pressure turbine 4 can be temporarily placed in a relatively small area. Besides, while a low-pressure turbine 4 is overhauled, work for shifting an overhead crane 21 from the upper outer casing 10 to the upper inner casing 11 and again to the upper outer casing 10 is unnecessary, and hence no retreating-space for the upper outer casing 10 is required.

Moreover, in accordance with any embodiment, the disassembly and reassembly of a turbine unit at the time of periodical inspection progress without being disturbed or delayed by said otherwise-required crane-shift between the casings. Furthermore, because the three-dimensional temporary placing of disassembled components saves space, enlarging passages between them and working spaces around them, the temporary-placing work of disassembled components and the inspection of the turbine unit can be carried out efficiently. Thus, the time required for the inspection of the turbine unit can be reduced.

The above effect is brought about not only in periodical inspection of turbine units but also in any extraordinary inspection in which casings have to be disassembled.

As described above, any embodiment of the present invention contributes to the reduction in time required for the overhaul of turbine units of power plants and thereby to the increase in the operating ratios of power plants. described above, the turbine unit of the present invention can be applied to nuclear power plants such as boiling-water-reactor power plants and pressurized-water-reactor power plants. The turbine unit of the present invention can also be applied to thermal power plants.

What is claimed is:

1. A method of disassembling a turbine unit, comprising the steps of:

removing upper outer casings from the turbine unit and placing said upper outer casings at positions other than a position of the turbine unit; and removing upper inner casings from the turbine unit and placing said upper inner casings on the upper outer casings.

2. A method of disassembling a turbine unit as claimed in claim 1, wherein said upper inner casings are placed on supports which are provided on said upper outer casings.

3. A method of disassembling a turbine unit, comprising the steps of:

removing upper outer casings from the turbine unit and placing said upper outer casings at position other than a position of the turbine unit;

setting a stand over each of the upper outer casings so that the stand straddles said each upper outer casing; and removing upper inner casings from the turbine unit and placing said upper inner casing on the stands.

4. A method of disassembling a turbine unit as claimed in claim 3, wherein each stand has a means for moving horizontally so as to take a position to straddle one of the upper outer casings.

5. A method of disassembling a turbine unit, wherein the upper inner casing of one turbine being disassembled, among a plurality of turbines, is placed on the upper outer casing of another turbine not being disassembled.

6. A method of disassembling a turbine unit as claimed in claim 5, wherein said upper inner casings are placed on supports which are provided on said upper outer casings.

7. A method of disassembling a turbine unit, wherein upper inner casings of one turbine unit being disassembled, among a plurality of turbine units, are placed on upper outer casings of other turbine units not being disassembled.

8. A method of disassembling a turbine unit as claimed in claim 7, wherein said upper inner casings are placed on supports which are provided on said upper outer casings.

9. A method of disassembling a turbine unit, comprising the steps of:

a setting a stand over an upper outer casing of one turbine not being disassembled, among a plurality of turbines, so as to have the stand straddle the upper outer casing; and placing an upper inner casing of another turbine being disassembled on the stand.

10. A method of disassembling and inspecting a turbine unit, comprising the steps of:

removing upper outer casings from the turbine unit and placing them at position other than a position of the turbine unit;

removing upper inner casings from the turbine unit and placing them on the upper outer casings;

inspecting the turbine unit;

assembling the upper inner casings to the turbine unit; and assembling the upper outer casings to the turbine unit.

11. A method of disassembling and inspecting a turbine unit, comprising the steps of:

removing upper outer casings from the turbine unit and placing them at positions other than a position of the turbine unit;

setting a stand over each of the upper outer casings so as to have the stand straddle said each casing;

removing upper inner casings from the turbine unit and placing said upper inner casings on the stands;

inspecting the turbine unit;

assembling the upper inner casings to the turbine unit;

removing the stands from over the upper outer casings; and assembling the upper outer casings to the turbine unit.

12. A method of disassembling and inspecting a turbine unit, the method comprising the steps of:

removing the upper outer casing from one turbine being disassembled, among a plurality of turbines, and placing said upper outer casing at a position other than a position of the turbine;

removing the upper inner casing from the turbine and placing it on the upper outer casing of another turbine not being disassembled;

inspecting the disassembled turbine; and assembling the removed upper inner casing to the disassembled turbine.

13. A method of disassembling and inspecting a turbine unit, comprising the steps of:

removing an upper outer casing from one turbine being disassembled, among a plurality of turbines, and placing said upper outer casing at a position other than a position of the turbine;

removing the upper inner casing from the turbine and placing said upper inner casing on a stand which is set in advance over the upper outer casing of another turbine not being disassembled so that the stand straddles the casing;

inspecting the disassembled turbine;

assembling the removed upper inner casing to the disassembled turbine; and assembling the removed upper outer casing to the disassembled turbine.

* * * * *